US005186697A

United States Patent [19]

Rennex

[11] Patent Number: 5,186,697

[45] Date of Patent: Feb. 16, 1993

[54] BI-DIRECTIONAL STAIR/TREADMILL/RECIPROCATING-PEDAL EXERCISER

[76] Inventor: Brian G. Rennex, 431 Muddy Branch Rd., #101, Gaithersburg, Md. 20878

[21] Appl. No.: 576,761

[22] Filed: Sep. 4, 1990

Related U.S. Application Data

[63] Continuation-in-part of Ser. No. 304,443, Jan. 31, 1989, abandoned.

[51] Int. Cl.[5] ..... A63B 22/04

[52] U.S. Cl. ..... 482/52; 128/25 R

[58] Field of Search ..... 272/69, 70, 72, 73, 272/97, 130; 482/52, 53, 57, 51, 70, 54, 1; 128/25 R

[56] References Cited

U.S. PATENT DOCUMENTS

| | | | |
|---|---|---|---|
| 4,555,108 | 11/1985 | Monteiro | 272/69 |
| 4,681,316 | 7/1987 | DeCloux | 272/70 |
| 4,720,093 | 1/1988 | Del Mar | 272/70 |
| 4,733,858 | 3/1988 | Lan | 272/70 |

*Primary Examiner*—Stephen R. Crow
*Attorney, Agent, or Firm*—Lowe, Price, LeBlanc & Becker

[57] ABSTRACT

This invention is an improvement in stair exercising equipment which recognizes the importance of training muscle groups, tendons, and ligaments for walking downhill on steps or on an incline. Accordingly, it provides powered means for a moveable staircase, for an incline, or for reciprocating pedals to rise, thereby allowing a person to walk downhill.

6 Claims, 3 Drawing Sheets

BI-DIRECTIONAL STAIR/TREADMILL/RECIPROCATING-PEDAL EXERCISER

RELATED APPLICATION

This application is a Continuation-In-Part of U.S. patent application Ser. No. 07/304,443 filed Jan. 31, 1989, now abandoned.

BACKGROUND OF THE INVENTION

This invention relates to exercise and, in particular, to an improvement in conventional stair-exercise, reciprocating-pedal, or treadmill equipment. This improvement allows a person change direction in order to walk downhill, as well as uphill, while using this equipment.

The primary benefit of stair exercise equipment is well established—namely, the ability to achieve indoors, a range of levels of exercise from moderate to intense while avoiding the kind of damage to the joints, muscles, tendons, and ligaments inherent in running. This benefit is largely due to the low-impact nature of stair climbing. In addition, this type of equipment is portable. Use of multi-story stairwells or escalators is not practical for a user.

Stair climbing prepares one's body for the vigorous uphill requirements of mountain hiking, but it does not prepare muscle and sinew groups for the extreme demands of downhill hiking. Anyone who has done long mountain hikes knows that the most likely source of injury is due to the downhill part of the hike. Accordingly, this invention will greatly benefit those who train indoors for outdoor activities.

The prior art includes treadmill exercisers, such as Parsons (U.S. Pat. No. 3,592,466) and Harrison (U.S. Pat. No. 3,497,215), as well as exercisers featuring reciprocating pedals such as Champoux (U.S. Pat. No. 3,747,924), McFee (U.S. Pat. Nos. 3,970,302 and 4,470,597), DeCloux (U.S. Pat. No. 4,685,669), and Potts (U.S. Pat. No. 4,708,338). Monteiro (U.S. Pat. No. 4,555,108) has a variation of the treadmill design with steps on a rotating drum. None of these, however, provide for continuous downward stepping. Apparently, these inventors had never been made aware of the importance of downhill conditioning.

Smith et al. (U.S. Pat. No. 4,591,147) and Ramhorst (U.S. Pat. No. 4,776,582) have provisions for elevating treadmill machines in such a manner that the user walks uphill. These provisions are not convenient to make and would not serve to enable a user to walk downhill.

Wilkinson (U.S. Pat. No. 4,659,075) provides for single step-up, followed by single step-down. The lack of capability to continuously step down would make this an unsatisfactory mode of exercising. Ideally, one would like to step uphill continuously for a period of time, followed by downhill stepping for another period of time. And, ideally, uphill and downhill intervals could be repeated and varied. Finally, "climber" exercisers require a user to hold on with her hands in order to not fall backwards. These are not convenient for long exercise sessions aimed primarily at leg strengthening, and these do not exercise leg muscle groups in a sufficiently equivalent manner for conditioning for mountain or hill hiking.

Accordingly, the object of the instant invention is to allow one to train more completely for vigorous recreation such as mountain hiking by virtue of the capability to train by walking downhill as well as uphill.

FIG . 5 is a side view of a typical treadmill/stair-exerciser for upward stepping only.

Figure 6:
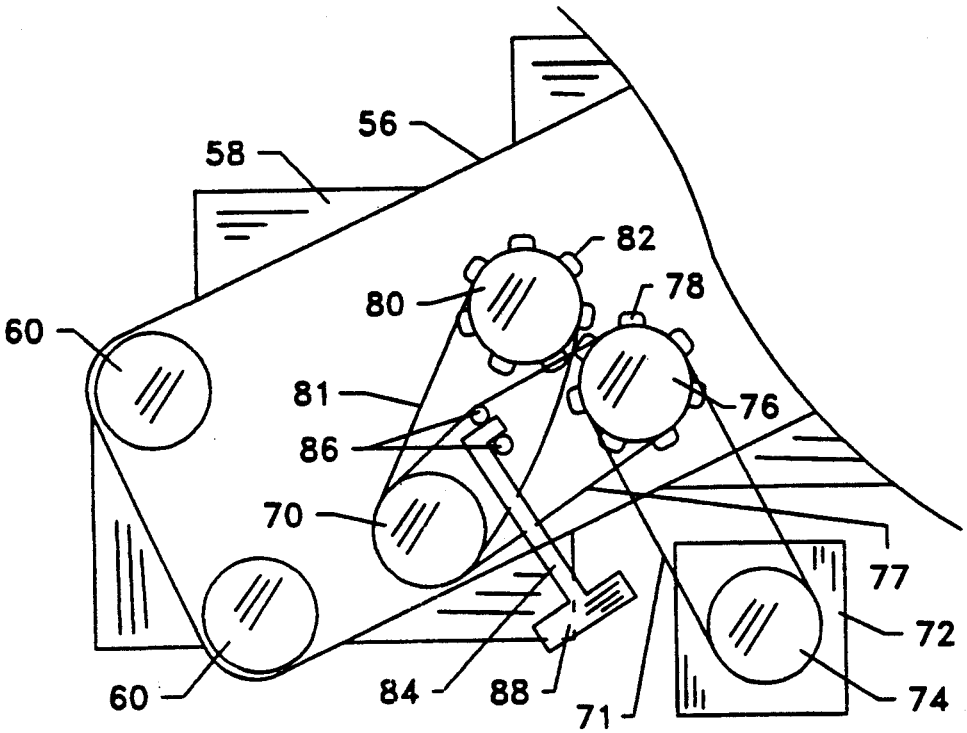

FIG. 6 is a side view of part of the second embodiment of the invention showing a reversing gear for treadmill and rotary stair exercise equipment.

Figure 7:
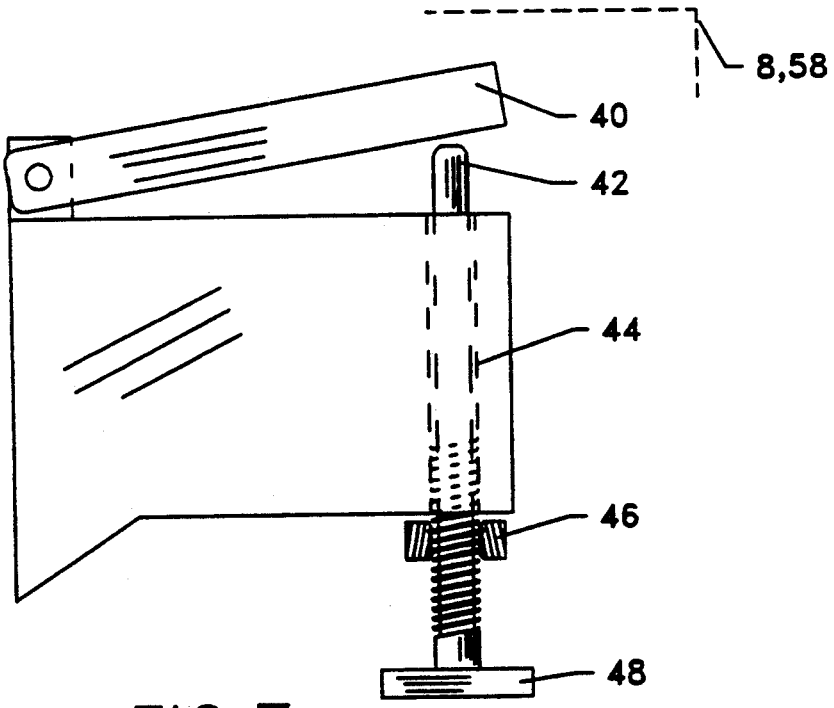

FIG. 7 is a side view of a step assembly with a "variable slope."

DESCRIPTION

The basic idea of this invention is to provide a portable stepping exercise device with the option for a person to step either continuously downward or continuously upward, for exercising the corresponding two different sets of leg muscle groups.

Typical stepping exercisers with reciprocating foot pedals only allow upward stepping. These work in such a manner that the user's weight depresses a foot pedal against a controlled resistance. The user's weight is also used to raise the other, unweighted foot pedal in preparation for weight change to the other foot. This design can be passive, since the user's weight, or the work done by the user, is adequate to return the unweighted foot pedal to its original position.

In order to improve this reciprocating-foot-pedal design to allow downward stepping, significant modifications are required. The basic difficulty is that the weighted foot pedal must be lifted upward, rather than allowed to move downward. The lifting of the user's weight can only be accomplished with an active, motor-driven design.

Figure 1:
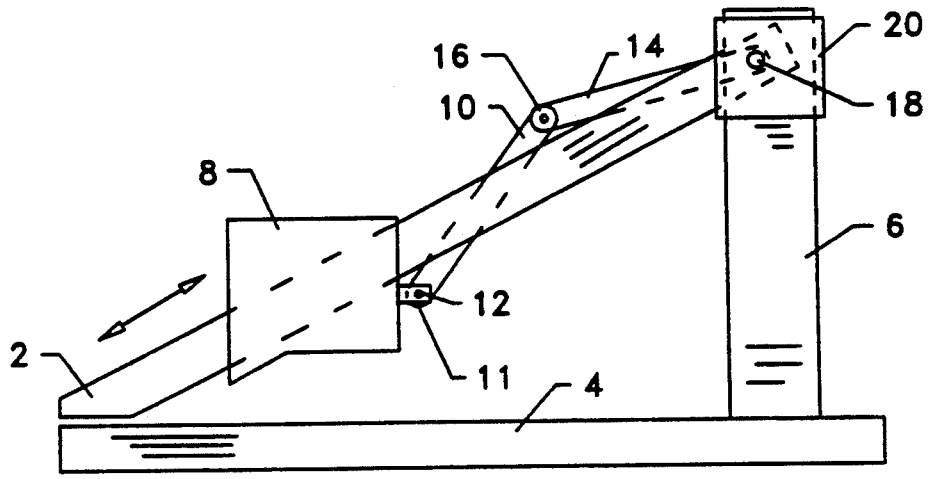
FIG. 1 is a side view of the first embodiment of the invention showing a step-lifting means for lifting the user as he steps down onto the other step with the other foot.
Figure 2:
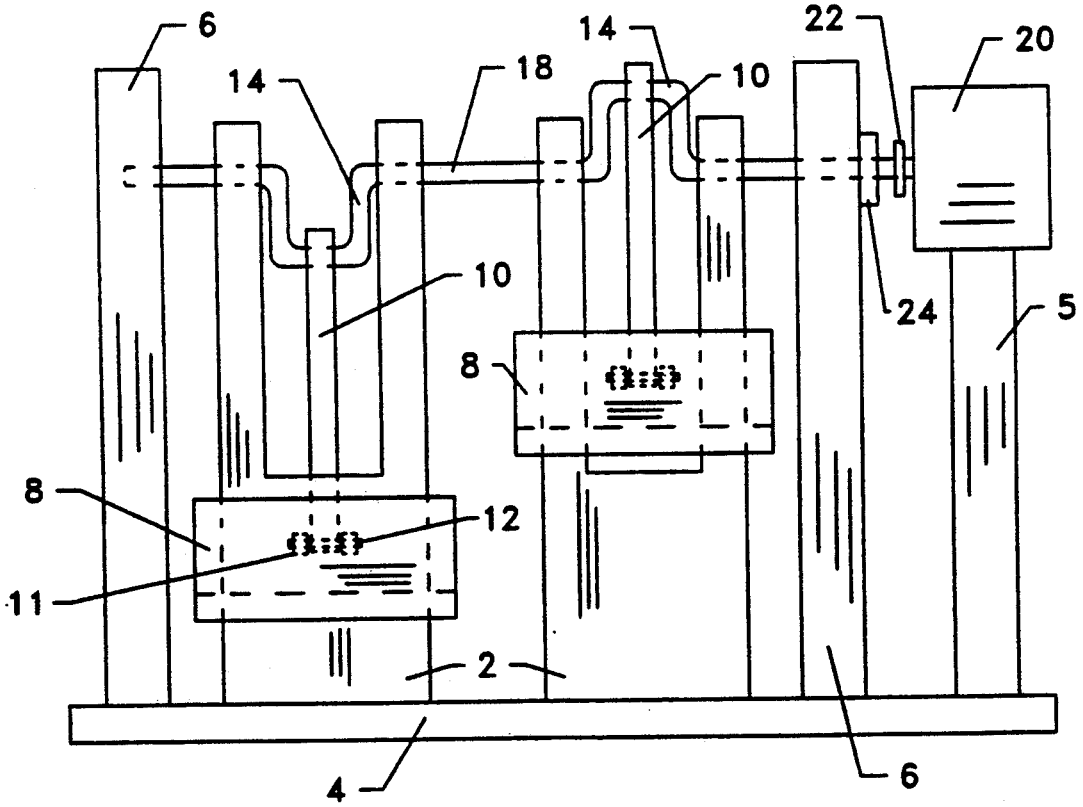
FIG. 2 is a top view of the first embodiment of the invention showing both sides of the step-lifting means for lifting the user as he steps down onto the other step with the other foot.

Accordingly, the first embodiment of this invention, shown in FIGS. 1-3, which can be used with stepping exercisers based on the design feature of reciprocating foot pedals, is motor-driven. It should be understood, as depicted in FIG. 2, that there is required a pair of the invention components shown in FIG. 1—one for each foot.

An inclined support member 2 is fixably attached at one end to frame base 4 and at the other end to frame vertical support 6. Step assembly 8 is slidingly attached to inclined support member 2.

Step assembly 8 is lifted along inclined support member 2 by a reciprocating motion means comprised of the following components. Crank link 10 is rotatably attached both to step assembly 8, via step tab 11 and step pin 12, and to crank arm 14 by crank link hole 16. Crank arm 14 is part of crank shaft 18, which is rotatably connected to the upper end of frame vertical support 6 on one side and to motor 20 on the other side.

Figure 3A:
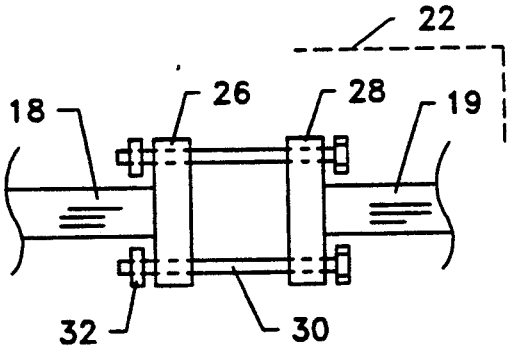
FIGS. 3A and 3B depicts elements of the first embodiment of the invention showing a coupling means for changing stepping direction and a resistance means used when stepping upwards.
Figure 3B:
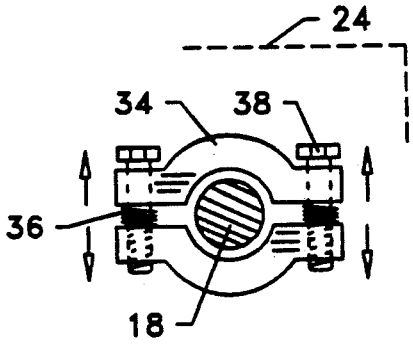

FIGS. 3A and 3B shows details of both the coupling means 22 and the resistance means 24 of FIG. 2. Coupling means 22 consists of motor-side collar 26 fixably attached to motor shaft 19 and of crank-side collar 28 fixably attached to crank shaft 18. Motor-side collar 26 and crank-side collar 28 are reversibly coupled with coupling bolts 30 and coupling bolt pins 32. Motor 20 is supported by motor support member 5. Resistance means 24 consists of brake collars 34 which are pressed against crank shaft 18 by brake bolts 38 acting against brake springs 36.

The bi-directional function of the first embodiment is accomplished as follows. For upward stepping, coupling bolts 30 are removed from motor-side collars 26, freeing step assembly 8 from motor-driven motion. At the same time, brake bolts 38 are tightened against brake springs 36 and against crank shaft 18, to achieve the desired resistance to downward motion of step assembly 8 when the user steps on the upper of the two step assemblies 8. Note that when one step assembly moves down, the other is constrained to move up, due to their connection via crank shaft 18. This constrained reciprocating action is typical of reciprocating pedal exercisers for upward stepping.

For downward stepping, the direction mode is changed by connecting motor-side collar 26 with crank-side collar 28 with coupling bolts 30. At the same time, brake bolts 38 are loosened to eliminate resistance to turning motion of crank shaft 18. Motor 20 is then turned on at the desired speed, causing crank arms 14 to rotate. This rotation results in reciprocating motion of step assemblies 8, via crank arms 14. Note that the two crank arms are oriented in opposite directions, causing the respective motions of the two step assemblies 8 to be in opposite directions.

The user steps down from one step assembly 8 when it is at or near its highest position unto the other step 8, which is at or near its lowest position. The user's center of mass is then lifted by the upward motion of this other step assembly 8 until it, it turn, reaches or is near its highest position, at which time the user steps down unto the first step assembly 8. In this manner, the user steps continuously downward, while the invention transports the user continuously upward, in such a manner that the vertical position of the user remains approximately the same.

Figure 4:
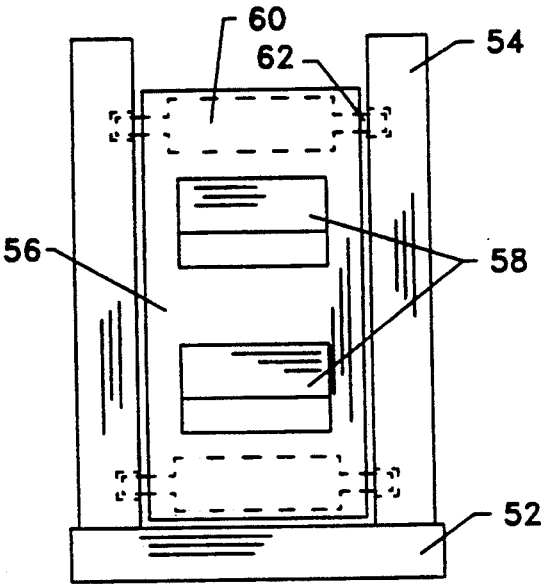
FIG. 4 is a front view of part of the typical stair exercisers pertinent to the second embodiment of the invention. It shows the support frame for the treadmill belt.
Figure 5:
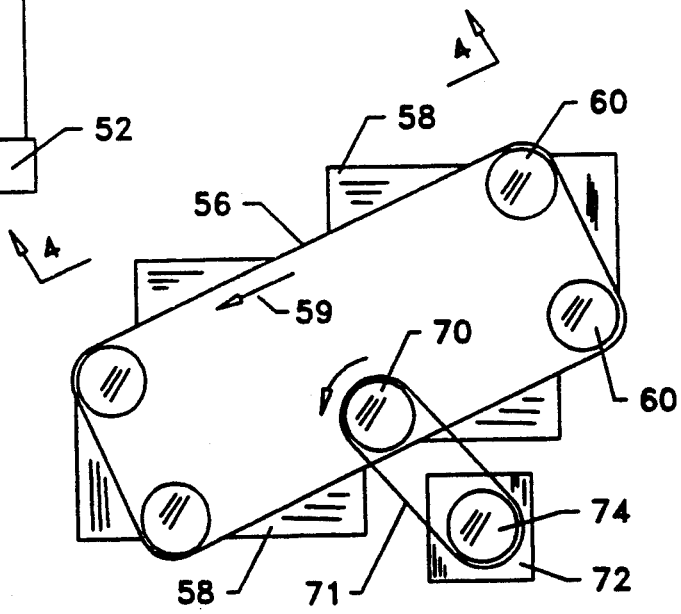

Referring to FIGS. 4 and 5, there are shown front and side views of a conventional treadmill or rotary stair exerciser. Typically, in these types of equipment, stepping assemblies 58 move continuously downward, as indicated by downward arrow 59. This allows the user to step continuously upward. In this treadmill design, stepping assemblies 58 are attached to belt 56 which is driven in a counterclockwise direction by drive pulley 70, via drive pulley 70 connected to motor pulley 74 driven by motor 72. Belt pulleys 60 support belt 56 on both ends. It should be understood that the various pulleys discussed in this embodiment are supported on both sides by virtue of rotatable connection to frame vertical supports 54, which extend on either side of the belt assembly and which are rigidly attached to frame base 52.

The second embodiment of the invention involves the addition of a feature to allow the user to walk downward by reversing the direction of the belt motion. Three examples of how this bi-directionality can be achieved are given here. The first example is to replace the uni-directional motor with a bi-directional motor, and to add an electrical switch to reverse the motor's direction.

The second example, shown in FIG. 6, involves the use of a reversing gear arrangement. Motor 72 runs in one direction and turns, via drive pulley belt 71, first pulley 76, fixably attached to first pulley gear 78, in the same direction. This causes first pulley belt 77 to turn in the same original direction. At the same time, first pulley gear 78 turns reverse pulley gear 82 in the opposite direction. Reverse pulley 80, fixably attached to reverse pulley gear 82, then turns reverse pulley belt 81 in the opposite direction.

Both first pulley belt 77 and reverse pulley belt 81 are wrapped around drive pulley 70. First pulley belt 77 will turn drive pulley 70 in the opposite direction from the direction in which reverse pulley belt 81 will turn drive pulley 70. Either the first pulley belt 77 or the reverse pulley belt 81 is tightened about drive pulley 70 by moving reversing lever from side to side. Reversing pulleys 86, fixably attached to the upper end of reversing lever 84, impinge against either first pulley belt 77 or reverse pulley belt 81 to achieve this tightening. Lever catch 88 holds reversing lever 84 in two positions, one for turning drive pulley 70 in one direction, and the second position for turning drive pulley 70 in the other direction. It should be understood that the various elements of this reversing feature are attached to frame vertical supports in a manner that is obvious to those skilled in the art. In addition, there are many reversing gears in the art which can be used in this application.

The third example of achieving bi-directionality is simply to raise the lower end of the belt system, with a jack system, so that it is above what was originally the upper end. Although this is not a particularly convenient way to achieve the reversing function, it is possible to cover a range of positive and negative slopes with such an example.

The third embodiment of the invention is shown in FIG. 7. It adds a feature to step assembly 8 of FIG. 1 or step assembly 58 of FIG. 5, whereby the slope of the top of the step can be varied. Accordingly, raised platform 40, rotatably attached on one side to step assembly 8, is raised on the other side by raising bolt 42, which passes through raising hole 44 and raising nut 46, fixably attached to the bottom of step assembly 8. Raising handle 48 turns raising bolt 42 to achieve this slope change.

It should be understood that the intent of this invention is to provide a versatile, free-standing, and portable step exerciser. As has been described, it is versatile in that the user can step upwards or downward, and the slope of the steps can be varied. Also, it should be obvious to one skilled in the art that it is possible to vary the angle of the incline, e.g., by varying the height of the attachment between frame vertical support 6 and crank shaft 18 of FIG. 2, or to vary length of the user's stepping action by varying the length of crank arm 14, or to vary the stepping speed by varying the speed of motor 20.

The invention is free-standing in that it does not depend on external architectural structure for support, as is the case with escalators. It is portable in that its size is roughly 1–6 feet in height, 2–6 feet in width and 3–6 feet in length. That is, it would be easy to transport this invention to homes or gyms.

Finally, the invention is distinguished from climber exercisers in that the user does not necessarily need to use her hands to keep from falling over backwards.

The above description shall not be construed as limiting the ways in which this invention may be practiced but shall be inclusive of many other variations that do not depart from the broad interest and intent of the invention.

Having thus described the invention, what is claimed as new and desired to be secured by Letters Patent is:

1. An improved portable stepping exerciser comprising:

a downward step assembly comprising a pair of movable steps and first means for repeatedly moving each of said steps from a first lower position to a first upper position, whereby the center of mass of a user who has stepped onto one of said steps is shifted upwardly when said step is moving upwardly;

an upward step assembly comprising said pair of movable steps and second means for repeatedly allowing each of said steps to move from a second upper position to a second lower position, whereby the center of mass of said user who has stepped onto one of said steps is shifted downwardly when said step is moving downwardly; and switching means coupled to said downward step assembly and said upward step assembly for selecting one of said assemblies for operation.

2. The improved portable stepping exerciser of claim 1, further comprising:

a pair of sliders, each of which is attached to a corresponding one of said steps; and a pair of guide/support members, each of which is oriented at a selected angle for constraining said corresponding step and said corresponding slider to move reciprocally along a predetermined incline.

3. The improved portable stepping exerciser of claim 2, further comprising:

a pair of frames, each of which supports a corresponding one of said guide/support members; and a variable speed motor coupled to said steps for changing the rate of ascent thereof.

4. The improved portable stepping exerciser of claim 1, wherein said switching means comprises:

a variable speed motor having a motor shaft, a crankshaft coupleable to said motor shaft, and coupling means for selectively engaging and disengaging said motor shaft and said crankshaft.

5. The improved portable stepping exerciser of claim 3, further comprising:

a crankshaft connected to said variable speed motor, a crank arm fixably connected to said crankshaft, and a crank link rotatably connected to said crank arm and to said slider, whereby rotation of said crank arm and said crankshaft causes reciprocating motion of each of said steps along said corresponding guide/support member.

6. The portable stepping exerciser of claim 1, further comprising:

a frame connected to said downward step assembly and said upward step assembly;

a raised platform having two ends, one of which is rotatably connected to said frame; and jack means for raising or lowering the other end of said raised platform, whereby the slope of said raised platform can be varied.

* * * * *